US006983634B2

(12) United States Patent
Chun et al.

(10) Patent No.: US 6,983,634 B2
(45) Date of Patent: Jan. 10, 2006

(54) ROTARY BENDING TOOL AND METHOD OF MANUFACTURE

(75) Inventors: Victor Chun, Walton Hills, OH (US); Frank Madej, Mentor, OH (US)

(73) Assignee: Danly IEM, Boston, MA (US)

( * ) Notice: Subject to any disclaimer, the term of this patent is extended or adjusted under 35 U.S.C. 154(b) by 20 days.

(21) Appl. No.: 10/632,692

(22) Filed: Aug. 1, 2003

(65) Prior Publication Data

US 2005/0022574 A1 Feb. 3, 2005

(51) Int. Cl.
*B21D 5/04* (2006.01)

(52) U.S. Cl. ..... 72/387; 72/381; 72/313

(58) Field of Classification Search ..... 72/312, 72/313, 319, 320, 387, 388
See application file for complete search history.

(56) References Cited

U.S. PATENT DOCUMENTS

| | | | | | |
|---|---|---|---|---|---|
| 4,002,049 | A | | 1/1977 | Randolph, Sr. | |
| 4,181,002 | A | | 1/1980 | Eckhold et al. | |
| 4,434,644 | A | * | 3/1984 | Gargrave et al. | 72/387 |
| 4,535,619 | A | | 8/1985 | Gargrave et al. | |
| 5,341,669 | A | * | 8/1994 | Katz | 72/387 |
| 5,404,742 | A | * | 4/1995 | Wilson et al. | 72/387 |
| 5,487,296 | A | * | 1/1996 | Gerhart et al. | 72/381 |
| 5,913,931 | A | * | 6/1999 | Gargrave et al. | 72/387 |

* cited by examiner

*Primary Examiner*—David Jones
(74) *Attorney, Agent, or Firm*—John R. Benefiel

(57) ABSTRACT

A rotary bending tool having a series of graphite plugs mounted in a saddle recess engaging a rocker surface to lubricate the same. The rocker is machined in an unhardened state and thereafter heat treated to be hardened, with reverse bending of the rocker thereafter carried out to correct any warpage.

3 Claims, 3 Drawing Sheets

ROTARY BENDING TOOL AND METHOD OF MANUFACTURE

BACKGROUND OF THE INVENTION

This invention concerns rotary bending tools of the type including a rocker rotationally mounted in a partially cylindrical seat in a saddle, tools used to form bends along an edge of a sheet metal workpiece by wrapping around an edge of an anvil die. The rocker has a lengthwise V-shaped recess which wraps the edge of sheet metal blank around an anvil die edge as the saddle is driven down in a press, the rotation of the rocker as it descend wrapping the sheet material around the lower die edge.

Such devices are used in high volume production of formed steel panels and thus are subject to considerable wear. Rockers for long length rotary bending tools have heretofore been constructed of very high strength alloys which are hardened prior machining, necessitating costly post hardening machining to very close tolerances as described in U.S. Pat. No. 5,913,931.

Also, sophisticated lubricating systems have been developed due to the demanding nature of this process to reduce tool wear in high volume production applications.

It is the object of the present invention to provide a lower cost simpler rotary bender which can be constructed in long lengths and used in high production volume applications.

SUMMARY OF THE INVENTION

The above objects or others which will be understood upon a reading of the following specification and claims are achieved by a rotary bender which incorporates graphite plugs in the saddle recess, contoured to conform to the rocker. The graphite plugs retain and dispense lubricant to provide an effective but simple lubrication of the rocker as it is oscillated in the saddle recess.

In manufacturing these components, the rocker is machined prior to being hardened, and thereafter heat treated, with any warpage eliminated by straightening the rocker in a press by reverse bending thereof.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
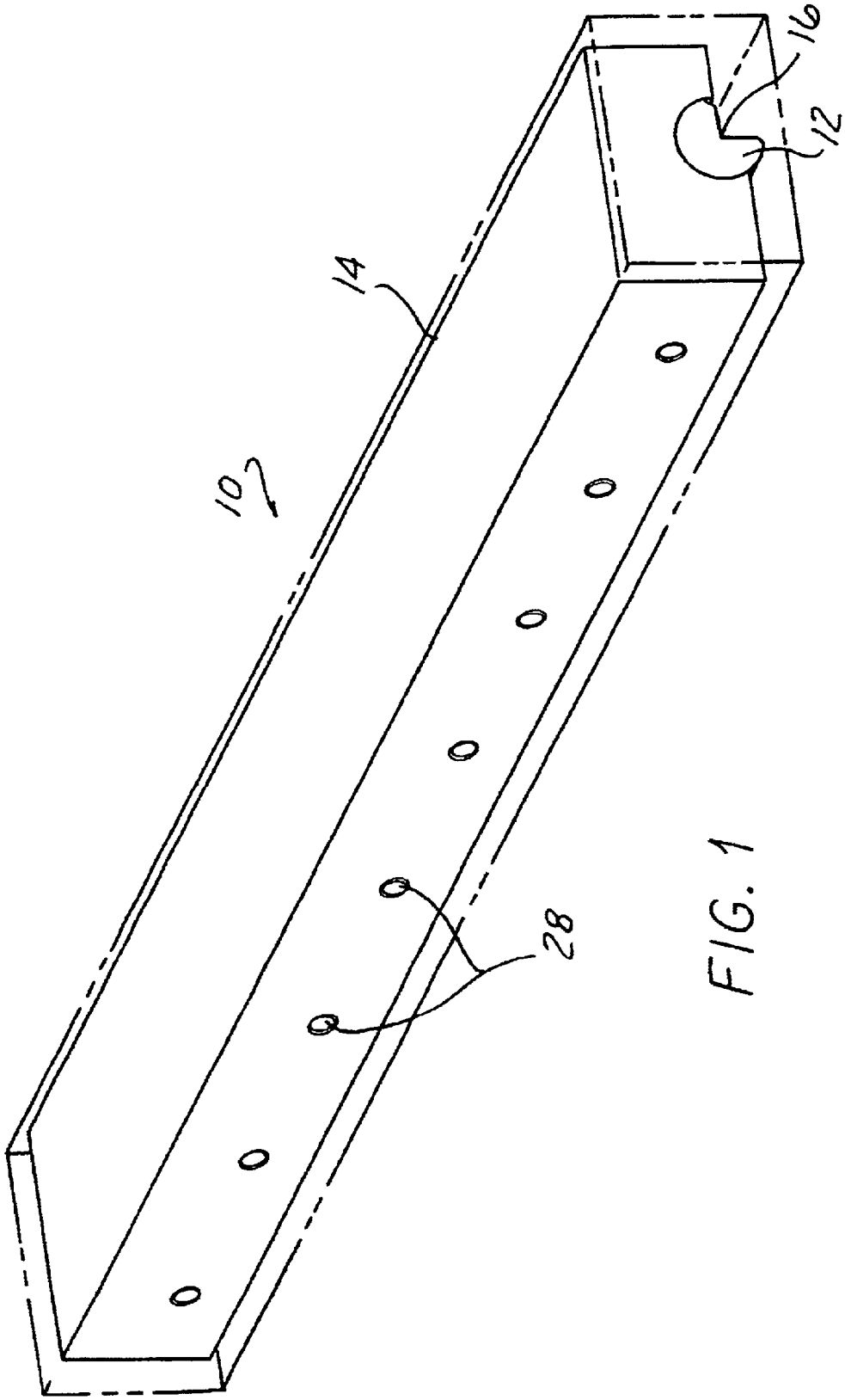
FIG. 1 is a perspective view of a rotary bending tool according to the present invention.
Figure 2:
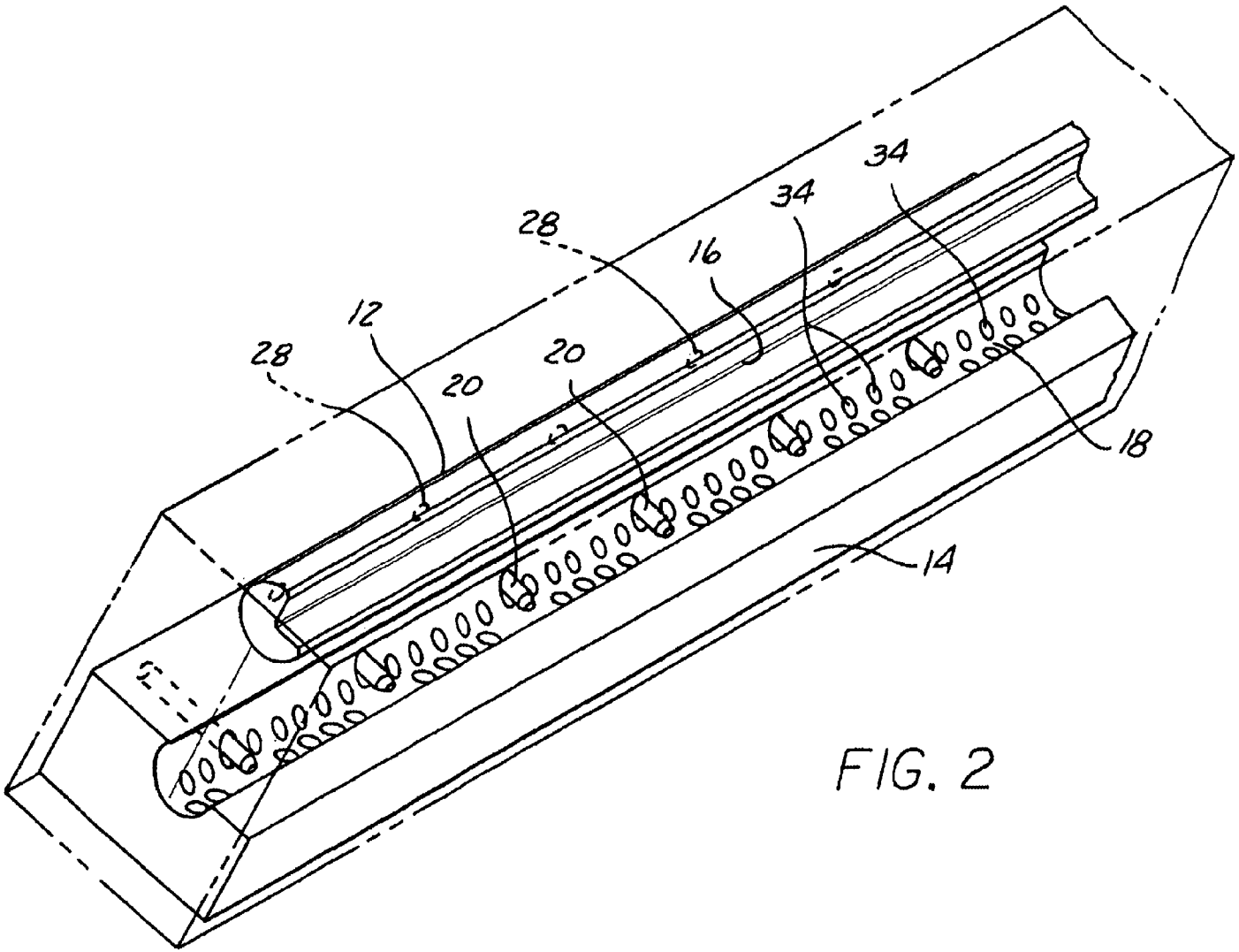
FIG. 2 is an exploded perspective inverted view of the rocker and saddle components included in the tool shown in FIG. 1.

Referring to the drawings, a rotary bending tool 10 according to the present invention is shown in FIG. 1, which includes a rocker 12 and a saddle 14. The rocker 12 is comprised of a generally cylindrical elongated shaft with a V-shaped lengthwise recess 16 machined therein. A suitable high strength steel allow is used to make the rocker 12. The remaining cylindrical portions of the rocker 12 are nested into an arcuate recess 18 extending lengthwise along the saddle 14. The rocker 12 is supported for oscillation in the saddle recess 18 by reason of the complementary cylindrical shape of the mating portions of the rocker 12 and saddle recess 18.

The rotary bending tool 10 is installed in a die press by means of cap screws (not shown) and mates with a lower die D having an elongated forming contour C around which a sheet metal workpiece is wrapped, as described in the above referenced patent, which process is well known in the art, and will not be further described here.

Figure 3:
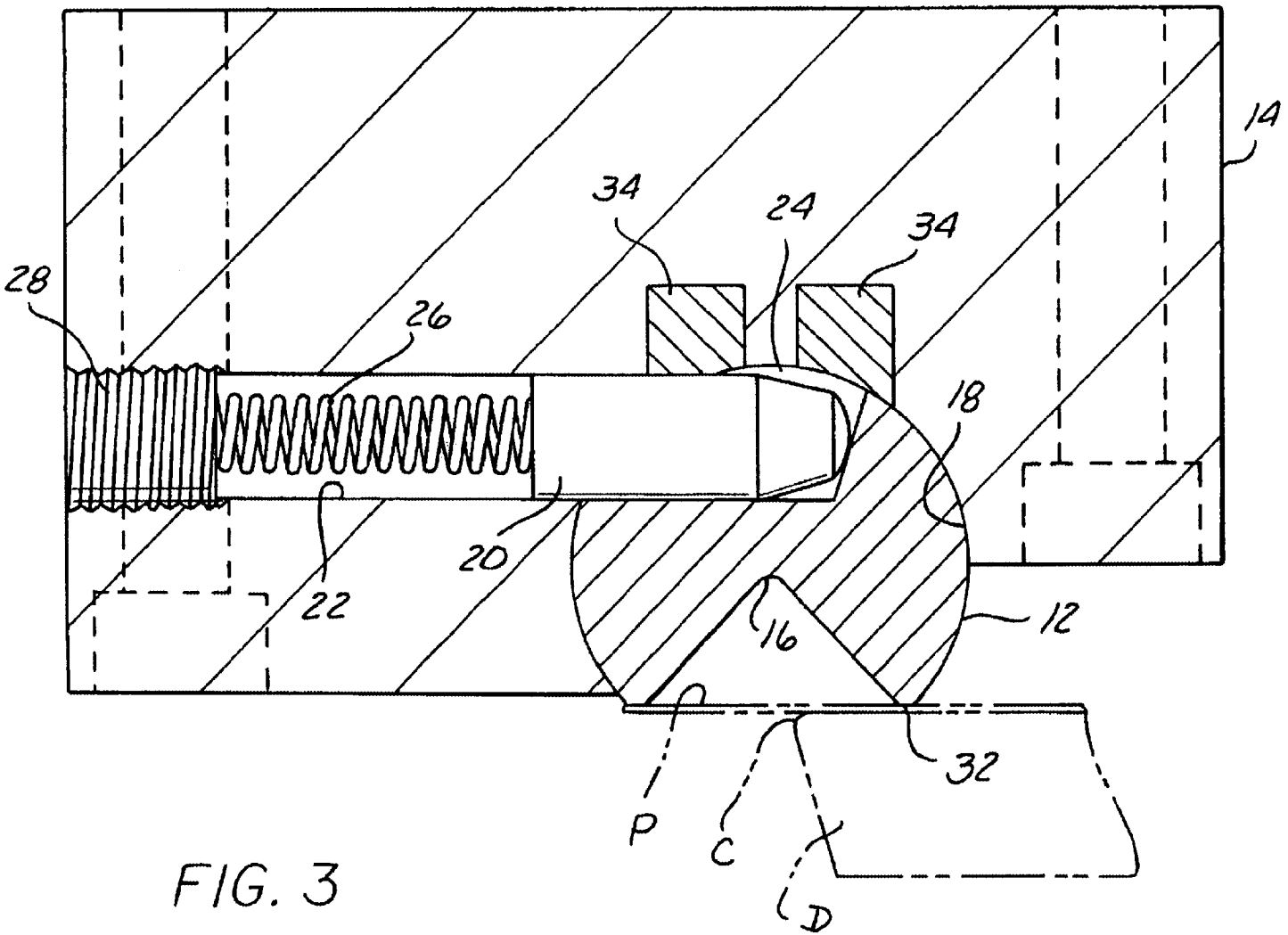
FIG. 3 is a transverse sectional view taken through the tool shown in FIG. 1.

As seen in FIG. 3, the rocker 12 is partially encircled by the saddle recess 18 to an extent sufficient to capture the rocker 12 and so as to be rotatable therein with the recess 18 facing down, as it would when the rotary bending tool 10 is affixed to the upper platen in a press (not shown). The rocker 12 is assembled therein by being slid endwise into the recess.

The rocker 12 is retained in this position by a series of tapered end pins 20 inserted through respective holes 22 in one side of the saddle 14 and received in respective pockets 24 in the rocker 12.

The tapered end pins 20 are urged towards the rocker 12 by compression springs 26 compressed by set screws 28 installed in threaded sections of holes 22.

The compressed springs 26 allow the pins 20 to be forced back as the rocker 12 is rotated counter clockwise by contact of one recess edge 32 with the sheet metal part P.

In order to lubricate the bearing surface of the rocker 12, two linear series of lubricant impregnated graphite plugs 34 are inserted in pockets in the saddle recess 18 in the region above the rocker 12. The ends of the graphite plugs 34 are machined to an arcuate shape matching the curvature of the rocker 12 and saddle recess 18. This arrangement has been found to adequately lubricate the rocker 12 even when the forming operations are continued over many cycles.

The rocker 12 is machined while in the unhardened state by conventional machining methods. After machining, the rocker 12 is inspected and any warpage is corrected by bending of the rocker 12 in a reverse direction to the warpage in a press able to exert sufficient force to carry out such bending. This technique has been found to produce sufficient accuracy of the finished rocker 12 for use with long length rotary bending tools (24 inches) while greatly reducing the manufacturing costs.

What is claimed is:

1. A rotary bending tool, comprising:

a saddle comprised of an elongated member formed with a partially cylindrical open recess extending lengthwise along said saddle;

a rocker comprised of an elongated member having a partially cylindrical outer surface fit to said partially cylindrical portion of said saddle recess, said saddle recess to allow relative rotation therein, said saddle partially encircling said rocker to capture the same;

said rocker having a V-shaped recess extending lengthwise along said rocker, said V-shaped recess positioned to face away from said saddle recess with said cylindrical saddle recess and said partially cylindrical surface of said rocker interfit together;

a series of pins each received in respective one of a series of holes in said saddle and entering a respective one of a series of pockets formed into said cylindrical surface of said rocker;

a spring associated with each pin holding said pin in said respective pocket of said rocker;

a series of oil impregnated graphite plugs mounted in a respective one of a series of pockets formed into a surface defining said saddle recess, said plugs each having an end engaging said rocker cylindrical surface, said series of plugs distributed along the length of said saddle recess, thereby lubricating said rocker cylindrical surface.

2. The rotary bending tool according to claim 1 wherein said series of graphite plugs are arranged in two side by side rows extending along said saddle recess.

3. The rotary bending tool according to claim 1 wherein each of said graphite plugs have an arcuately contoured end in engagement and conforming with said rocker cylindrical surface.

* * * * *